US006742526B1

(12) United States Patent
Riester

(10) Patent No.: US 6,742,526 B1
(45) Date of Patent: Jun. 1, 2004

(54) NAIL DESIGNER KIT

(76) Inventor: Janet E. Riester, P.O. Box 425, Dow City, IA (US) 51528

( * ) Notice: Subject to any disclaimer, the term of this patent is extended or adjusted under 35 U.S.C. 154(b) by 0 days.

(21) Appl. No.: 10/320,578

(22) Filed: Dec. 17, 2002

(51) Int. Cl.[7] ..... A45D 29/00
(52) U.S. Cl. ..... 132/73
(58) Field of Search ..... 132/73, 73.5, 315; 206/581, 458; 248/214, 227.4; 211/85.2

(56) References Cited

U.S. PATENT DOCUMENTS

| | | | | |
|---|---|---|---|---|
| 2,162,155 A | | 6/1939 | Calvin | |
| 2,234,657 A | | 3/1941 | Smaldone | |
| 2,262,977 A | | 11/1941 | Vasil | |
| 2,633,139 A | | 3/1953 | Pettey | |
| 2,746,460 A | | 5/1956 | Jellinek | |
| 3,982,551 A | | 9/1976 | Bartolucci | |
| 5,782,379 A | * | 7/1998 | Traub et al. | 221/93 |
| 5,813,415 A | * | 9/1998 | Slali | 132/73 |
| 5,904,149 A | * | 5/1999 | Ruhl et al. | 132/73 |

FOREIGN PATENT DOCUMENTS

| | | |
|---|---|---|
| GB | 2111431 A | 7/1983 |

* cited by examiner

*Primary Examiner*—Todd E. Manahan
(74) *Attorney, Agent, or Firm*—Richard C. Litman

(57) ABSTRACT

A nail designer kit for holding and manipulating artificial fingernails while being polished or decorated comprising a container and a plurality of design sticks on which artificial fingernails are mounted. When separated from the container, each design stick is easily handled and manipulated to facilitate applying nail polish and other decorations to artificial fingernails mounted thereto.

19 Claims, 4 Drawing Sheets

NAIL DESIGNER KIT

BACKGROUND OF THE INVENTION

1. Field of the Invention

The present invention relates to aids for polishing and decorating artificial fingernails and, more specifically, to a kit for holding and manipulating artificial fingernails while being polished and decorated.

2. Description of the Related Art

Artificial fingernails are widely used by women to improve the, appearance of their fingernails. With artificial fingernails, a woman is able to easily cover natural fingernails that may be cracked, chipped or uneven, with a set of fingernails of uniformed length that appear both polished and professionally manicured. Typically, artificial fingernails are constructed of a synthetic material that mimics the appearance and feel of natural fingernails, and are secured over a woman's natural fingernails via an adhesive.

Often nail polish, decals or other decorations are applied to artificial fingernails after they have been secured over natural fingernails. Unfortunately, however, once artificial fingernails have been secured in place, applying nail polish or other decorations can be messy, awkward and time-consuming. Nail polish is often spilled or painted onto fingers; applying polish to fingernails on the dominant hand requires use of the non-dominant hand; and time is required to both apply nail polish and to allow the polish to dry.

Consequently, a means for decorating artificial fingernails before they are secured in place, is desirable. Such a means would allow a woman to decorate artificial fingernails in advance of their use; to apply nail polish and other decorations with more precision; and to avoid being incapacitated while nails are drying.

Although the prior art does not teach such a means, it does teach a variety of aids for applying nail polish to fingernails on a person, and a variety of means for packaging and transferring artificial fingernails.

U.S. Pat. Nos. 2,162,155, 2,234,657 and 2,262,977 to, respectfully, Calvin, Smaldone and Vasil provide examples in the prior art of aids for applying nail polish to fingernails. These patents teach devices used for stenciling or masking fingernails that allow a user to apply polish to select areas of a fingernail and to avoid applying polish to areas of the fingers near a fingernail. However, while these devices aid in the decoration of a fingernail on a person, they are not useful for decorating a set of artificial fingernails prior to being secure over a person's own fingernails.

Examples in the prior art of devices for transferring artificial fingernails are provided by U.K. Pat. No. GB2,111,431A to Spackman and by U.S. Pat. Nos. 2,633,139 and 2,746,460 to, respectfully, Pettey and Jellinek. Each of these patents teaches a carrier sheet on which a set of artificial fingernails is arranged. The artificial fingernails are peeled from the carrier sheet and applied to a user's own fingernails. Although these devices may be helpful for transferring a set of artificial fingernails to a user's own nails, the devices do not facilitate holding and manipulating individual artificial fingernails while being polished, nor do they protect polished fingernails prior to application.

Similarly, U.S. Pat. No. 3,982,551 to Bartolucci teaches a kit fabricated by injection molding in which artificial fingernails are attached to a frame via a stem. The artificial fingernails are removed from the kit by breaking the stem. However, once removed from the kit, the artificial fingernail cannot be reattached to it. Hence, as with the devices taught by Spackman, Pettey and Jellinek, this device does not facilitate holding and manipulating individual artificial fingernails while being polished.

Consequently, none of the above inventions and patents, taken either singularly or in combination, is seen to describe the instant invention as claimed. Therefore, a nail designer kit solving the aforementioned problems is desired.

SUMMARY OF THE INVENTION

The present invention is a nail designer kit comprising a container and a plurality of design sticks on which artificial fingernails are mounted. Each stick can be slidably removed from and replaced in the container, and holds up to two artificial fingernails. When removed from the container, each stick can be easily handled and manipulated to facilitate applying nail polish and other decorations to an artificial fingernail mounted thereto. Once the artificial fingernail has been polished, the stick can be returned to the container while the fingernail dries.

Accordingly, it is a principle object of the invention to provide a device that allows an individual to easily handle and manipulate artificial fingernails, thereby facilitating polishing of artificial fingernails in a manner that is simple and error free, yet in a manner that results in polished fingernails that appear professionally prepared. Hence, it is a principle object of the invention to allow an individual to save both time and money by adeptly preparing her own artificial fingernails as opposed to having them prepared by a salon professional.

It is another object of the invention to allow artificial fingernails to be polished before being affixed to an individual's own fingernails, thereby allowing the polishing of an individual's fingernails when most convenient to the individual.

It is a further object of the invention to allow for drying of polished artificial fingernails before being affixed to an individual's own fingernails, thereby allowing an individual to perform normal activities without the worry of marring freshly polished nails.

Furthermore, it is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
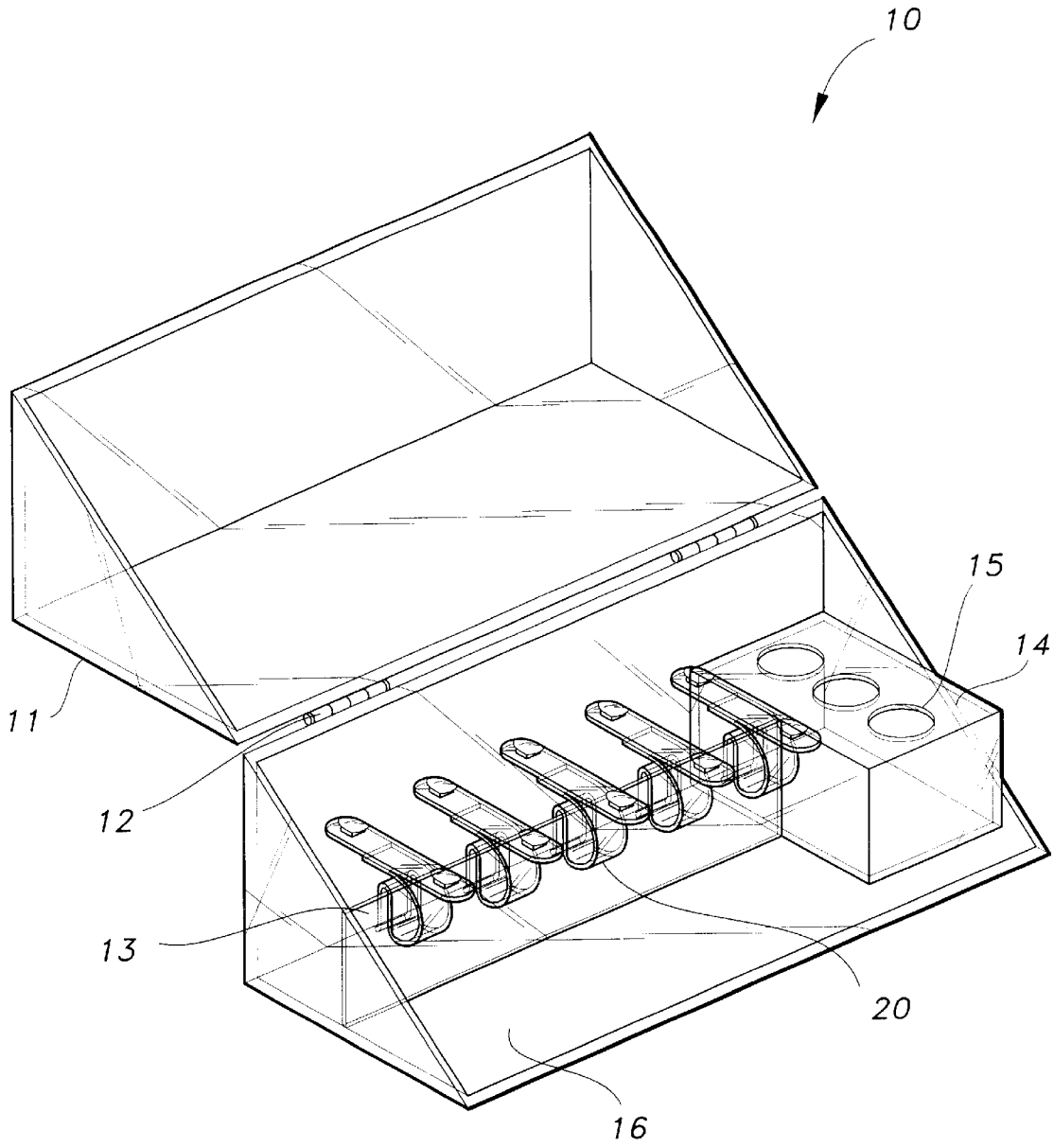
FIG. 1 is a perspective view of a nail designer kit according to the present invention.
Figure 2:
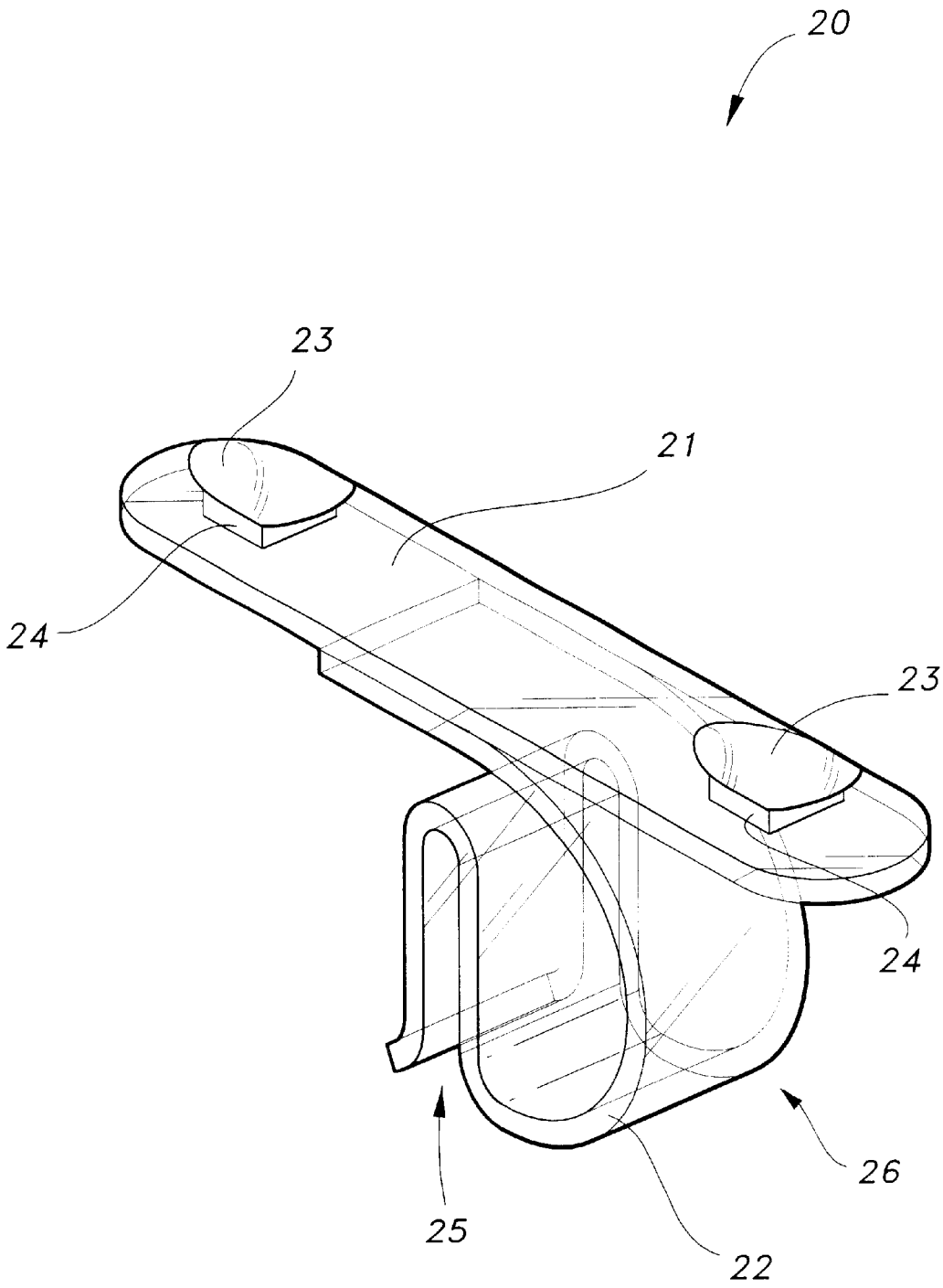
FIG. 2 is an enlarged-scale perspective view of a design stick from the nail designer kit shown in FIG. 1.
Figure 3:
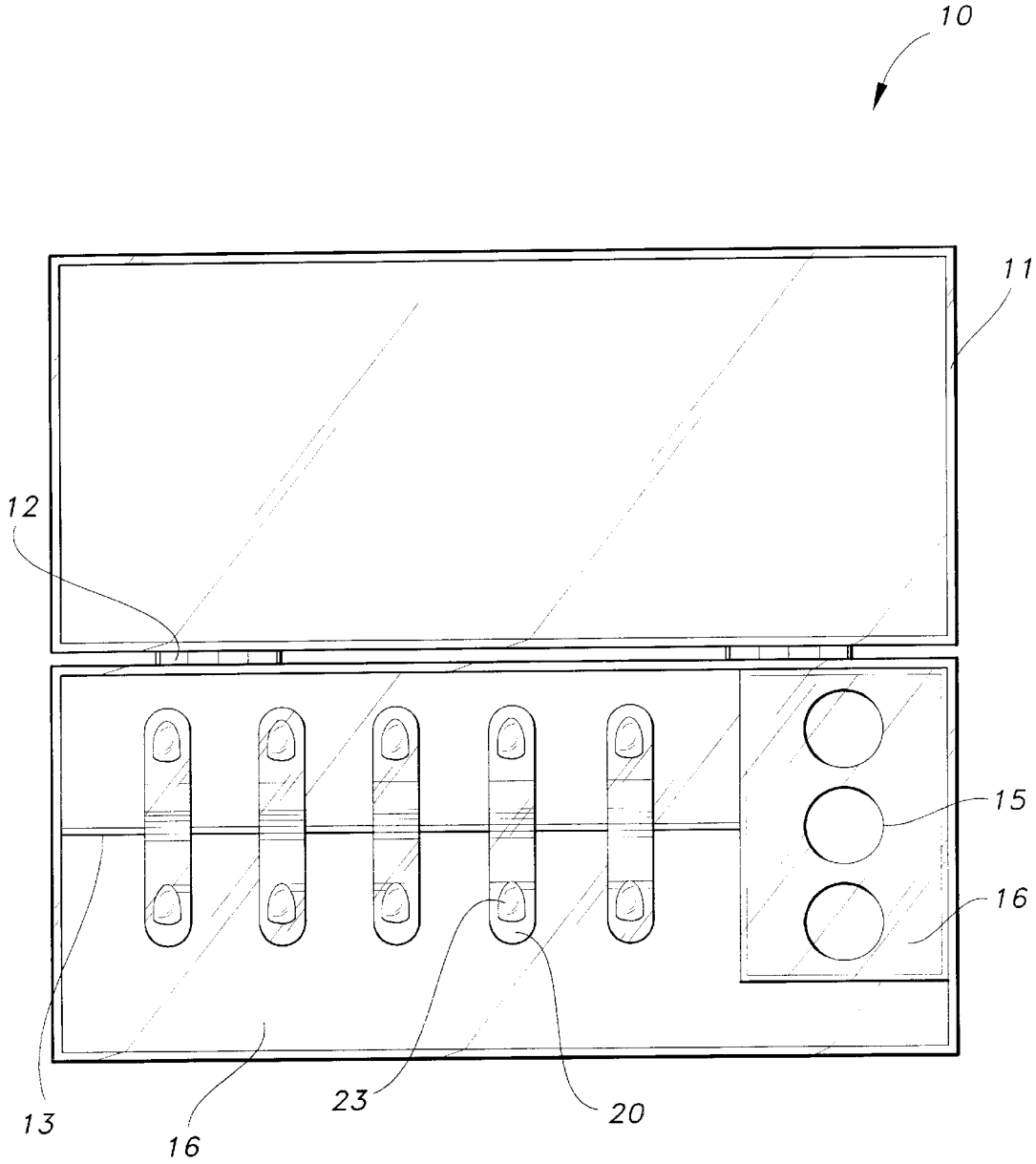
FIG. 3 is a top view of a nail designer kit shown in FIG. 1.
Figure 4:
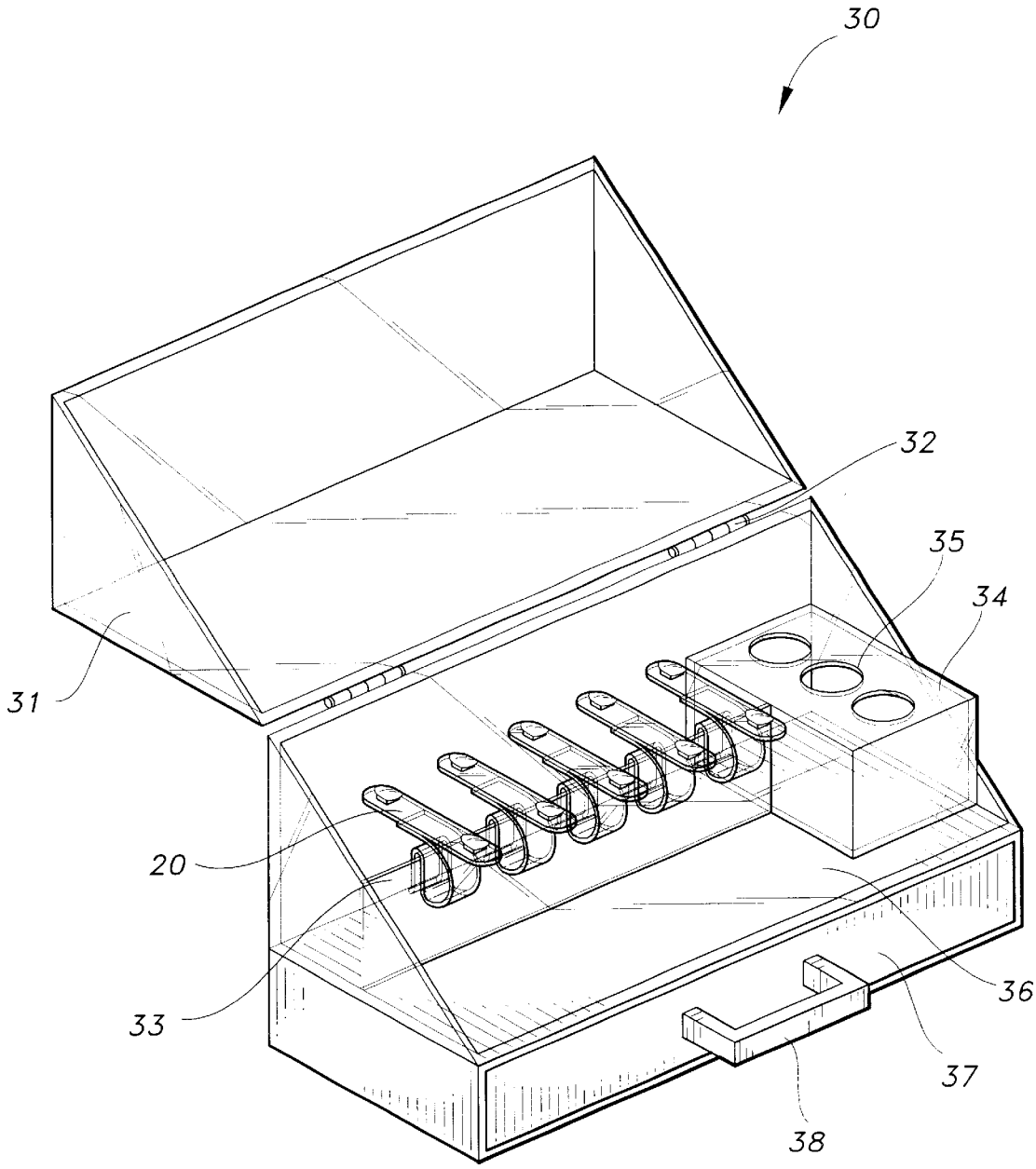
FIG. 4 is a perspective view of an alternative embodiment of a nail designer kit according to the present invention.

Referring to the drawings, FIGS. 1 through 3 illustrate a preferred embodiment of the present invention and FIG. 4 illustrates an alternative preferred embodiment.

FIG. 1 presents an elevational view of a nail designer kit 10 comprised of a container 11 and 16, an internal wall 13 within the container 11 and 16, an inner container 14, and a plurality of designer sticks 20.

The container 11 and 16 is a box constructed of a transparent or semi-transparent material. The container's lid 11 is attached to its base 16 via two hinges 12, and pivots open to provide access to the contents of the container 11 and 16. An internal wall 13 and an inner container 14 are secured to the interior of the container 11 and 16.

The internal wall 13 runs from one side of the container 11 and 16 to one side of the inner container 14, and design sticks 20 are mounted onto the its top edge. The height of the internal wall 13 is less than that of the container 11 and 16 such that the lid 11 of the container can be closed while design sticks 20 are mounted on the internal wall 13.

The inner container 14 is a box secured to the back, bottom and one side of the container 11 and 16. The top of the inner container 14 has three openings 15 which are shaped and dimensioned to receive a standard size bottle of fingernail polish. When a bottle of fingernail polish is placed in one of the openings 15, the bottle is held in place by the edges of the opening 15 with the bottle's bottom resting on the base of the inner container.

FIG. 2 shows a design stick 20. The design stick 20 is substantially flat and elongated with rounded ends and, like the container, is constructed of a transparent or semi-transparent material.

Two mounts 24 are located on the top surface 21 of the design stick 20, with an artificial fingernail 23 attached to each mount. Artificial fingernails 23 are secured to the mounts 24 either by a fastening means selected from the group consisting of prongs, clips, posts, tabs, vacuum cups, and suction cups; or by an adherent substance selected from the group consisting of waxes, clays, adhesives, cements, glycerins, polymers, sealants and adhesive tapes.

A handle 22 is attached to the bottom of the design stick. The handle is formed from an elongated rectangular piece of material and has groove 25 corrugated at one end. The groove 25 is shaped and dimensioned such that the design stick 20 is slidably attached to the internal wall 13 by lowering the corrugated groove 15 onto the top edge of the internal wall 13. From the corrugated groove 25, the handle arcs upward to the underside of the design stick, forming a semi-circular gripping area 26. An individual grips the handle 22 with her index finger and thumb by placing the index finger on the side of the gripping area 26 facing the corrugated groove 25 and the thumb on the opposite side.

When gripping the handle 22 with fingers from one hand, an individual is able to apply fingernail polish with the other hand.

FIG. 3 shows a top view of the nail designer kit 10 with the lid 11 in an open position. The design sticks 20 are mounted on the internal wall 13 with each design stick 20 having two, artificial fingernails 23 secured to its mounts 24. The inner container 16, with three openings 15 for receiving bottles of fingernail polish, is secured to the back and right side of the container 11 and 16.

FIG. 4 presents an alternative embodiment 30 of a nail designer kit according to the present invention. Like the embodiment discussed above, the alternative embodiment 30 includes a container 31 and 36, and an internal wall 33 within the container, an inner container 34, and a plurality of designer sticks 20. However, unlike the embodiment discussed above, the alternative embodiment also includes a drawer 37 with a handle 38. The drawer 37 allows items related to polishing and decorating artificial fingernails to be stored in the nail designer kit 30.

It is to be understood that the present invention is not limited to the embodiments described above, but encompasses any and all embodiments within the scope of the following claims.

I claim:

1. A nail designer kit comprising:

a container;

a plurality of design sticks contained within said container;

support means for said design sticks, said support means contained within said container, whereby each of said design sticks is attachable to and removable from said support means; and means for affixing at least one artificial fingernail to each of said design sticks;

each of said design sticks being substantially flat and elongated with a top and a bottom; and said means for affixing artificial fingernails to said design sticks located on said top of said design sticks.

2. The nail designer kit according to claim 1, wherein:

said container is a box with a top, a bottom, a front, a back and two sides.

3. The nail designer kit according to claim 2, further comprising:

a lid;

said lid comprising said top of said container and said lid being attached to said back of said container by at least one hinge;

whereby contents of said container is accessible when said lid is pivoted into an open position.

4. The nail designer kit according to claim 1, wherein:

said design sticks number between four and eight.

5. The nail designer kit according to claim 1, wherein:

each of said design sticks is between three inches and four inches in length and is less than one inch in width.

6. The nail designer kit according to claim 1, wherein:

said means for affixing artificial fingernails to each of said design sticks is a mechanical fastener selected from the group consisting of prongs, clips, posts, tabs, vacuum cups, and suction cups.

7. The nail designer kit according to claim 1, wherein:

said means for affixing artificial fingernails to each of said design sticks is a substance selected from the group consisting of waxes, clays, adhesives, cements, glycerins, polymers, sealants and adhesive tapes.

8. A nail designer kit comprising:

a container;

a plurality of design sticks contained within said container;

means for affixing at least one artificial fingernail to each of said design sticks;

each of said design sticks being substantially flat and elongated with a top and a bottom; and said means for affixing artificial fingernails to said design sticks located on said top of said design sticks;

an internal wall within said container; and means for securing said design sticks to said internal wall;

said internal wall being rectangular with a front, a back, a top edge, a bottom edge and two side edges;

whereby each of said design sticks is attachable to and removable from said internal wall.

9. The nail designer kit according to claim 8, wherein:

said means for securing each of said design sticks to said internal wall is a groove corrugated from an elongated piece of material attached to said bottom of each of said design sticks;

whereby each of said design sticks is attachable to said internal wall by lowering said design stick onto said internal wall so that said top edge of said internal wall slides into said groove.

10. A nail designer kit comprising:

a container;

an internal wall within said container;

a plurality of design sticks, each being substantially flat and elongated with a top and a bottom, and each being between three inches and four inches in length and less than one inch in width;

an elongated piece of material having a corrugated groove, attached to said bottom of each of said design sticks;

a means for affixing at least one artificial fingernail to each of said design sticks selected from the group consisting of prongs, clips, posts, tabs, vacuum cups, and suction cups;

said container being a box with a top, a bottom, a front, a back and two sides;

said internal wall being rectangular with a front, a back, a top edge, a bottom edge and two side edges;

whereby each of said design sticks is attachable to and removable from said internal wall and whereby each of said design sticks is attached to said internal wall by lowering said design stick onto said internal wall so that said top edge of said internal wall slides into said groove.

11. The nail designer kit according to claim 10, wherein:

said container is constructed of transparent material.

12. The nail designer kit according to claim 10, wherein:

said container is constructed of semi-transparent material.

13. The nail designer kit according to claim 10, further comprising a drawer.

14. The nail designer kit according to claim 10, further comprising:

an inner container contained within said container;

said inner container attached to interior of said container;

said inner container having a top with at least one opening; said opening in said inner container shaped and dimensioned to accommodate a standard size bottle of nail polish;

whereby, when inserted into said opening of said inner container, a bottle of nail polish is secured in place.

15. A nail designer kit comprising:

a container;

an internal wall within said container;

a plurality of design sticks, each being substantially flat and elongated with a top and a bottom, and each being between three inches and four inches in length and less than one inch in width;

an elongated piece of material having a corrugated groove, attached to said bottom of each of said design sticks;

a means for affixing at least one artificial fingernail to each of said design sticks selected from the group consisting of waxes, clays, adhesives, cements, glycerins, polymers, sealants and adhesive tape;

said container being a box with a top, a bottom, a front, a back and two sides;

said internal wall being rectangular with a front, a back, a top edge, a bottom edge and two side edges;

whereby each of said design sticks is attachable to and removable from said internal wall and whereby each of said design sticks is attached to said internal wall by lowering said design stick onto said internal wall so that said top edge of said internal wall slides into said groove.

16. The nail designer kit according to claim 15, wherein:

said container is constructed of transparent material.

17. The nail designer kit according to claim 15, wherein:

said container is constructed of semi-transparent material.

18. The nail designer kit according to claim 15, further comprising a drawer.

19. The nail designer kit according to claim 15, further comprising:

an inner container contained within said container;

said inner container attached to interior of said container;

said inner container having a top with at least one opening;

said opening in said inner container shaped and dimensioned to accommodate a standard size bottle of nail polish;

whereby, when inserted into said opening of said inner container, a bottle of nail polish is secured in place.

* * * * *